US005511663A

United States Patent [19]

Shimura et al.

[11] Patent Number: 5,511,663

[45] Date of Patent: Apr. 30, 1996

[54] PACKAGING CASE HAVING IMPROVED SIDEWALL STRUCTURE

[75] Inventors: Noboru Shimura, Fujisawa; Tamotsu Aiba; Takashi Nakamura, both of Chuo; Teruyoshi Sukegawa, Niihari, all of Japan

[73] Assignee: Kureha Kagaku Kogyo Kabushiki Kaisha, Tokyo, Japan

[21] Appl. No.: 353,516

[22] Filed: Dec. 9, 1994

[30] Foreign Application Priority Data

Dec. 15, 1993 [JP] Japan ..... 5-72122 U
May 24, 1994 [JP] Japan ..... 6-133640

[51] Int. Cl.[6] ..... B65D 5/72

[52] U.S. Cl. ..... 206/395; 206/408; 225/49

[58] Field of Search ..... 206/395, 396, 206/408, 409; 225/48–50

[56] References Cited

U.S. PATENT DOCUMENTS

| | | | |
|---|---|---|---|
| 2,458,844 | 1/1949 | Foote | 206/408 X |
| 2,472,521 | 6/1949 | Danerbener | 206/395 X |
| 2,624,521 | 1/1953 | Broeren | 206/395 |
| 2,803,339 | 8/1957 | Kuchenbecker | 206/396 |
| 3,229,812 | 1/1966 | Metzger | 206/408 X |
| 3,246,742 | 4/1966 | Coe | 206/408 X |
| 4,298,123 | 11/1981 | Roccaforte . | |

FOREIGN PATENT DOCUMENTS

| | | | |
|---|---|---|---|
| 63-55043 | 3/1988 | Japan . | |
| 1-9151A | 12/1989 | Japan . | |
| 4072139 | 3/1992 | Japan | 206/395 |
| 489732 | 8/1992 | Japan . | |

*Primary Examiner*—Bryon P. Gehman
*Attorney, Agent, or Firm*—Hickman Beyer & Weaver

[57] ABSTRACT

A packaging case includes a case body for storing a wrap film and a lid continuously formed with the top edge portion of a rear wall of the case body. Flap pieces extend outward to be pivotal on the top edge portions of side walls of the case body. Stepped portions engaged with the flap pieces to prevent floating of the lid are formed on the inner surfaces of lid side walls covered on the side walls of the main body during closing of the lid. Predetermined portions of the side walls of the main body continuous with the flap pieces are made thinner than remaining portions of the side walls. The inner surfaces of the remaining portions are located inside the inner surfaces of the predetermined portions.

46 Claims, 7 Drawing Sheets

PACKAGING CASE HAVING IMPROVED SIDEWALL STRUCTURE

BACKGROUND OF THE INVENTION

1. Field of the Invention

The present invention relates to a case for packaging a wrap film, an aluminum foil, paper or the like which is rolled on a cylindrical core.

2. Related Background Art

Various conventional wrap film cases are known. Generally, each case comprises a case body for storing a rolled wrap film and a lid integrally formed with the case body, as described in Japanese Patent Laid-Open Nos. 63-55043 and 64-9151. In use of such a conventional case, the following operations are generally performed. A user opens the lid upward and pulls the wrap film from the case body by a desired length. The wrap film is then cut with a cutter mounted on the bottom wall of the case body or the front wall of the lid.

However, in a general conventional wrap film case, as a case body is simply covered with a lid, the lid may float to externally expose the opening portion of the case body, depending on a way of handling the case. To expose the opening portion of the case body is not preferable from the sanitary viewpoint or may cause the wrap film to drop from the case body. In addition, while the lid is kept floating, the free end of the wrap film may be rewound into the case body to make it difficult to pull the wrap film in re-use.

To solve the above problem, there is proposed a conventional packaging case having a lid floating preventive function, as described in Japanese Utility Model Laid-Open No. 4-89732. This case has flap pieces extending downward on the outer sides of top edge portions of right and left side walls of case body, and stepped portions projecting inward on the inner surfaces of right and left side walls of a lid. When the case body is capped by the lid, the flap pieces engage with the stepped portions to prevent the lid from floating.

In the case described in Japanese Utility Model Laid-Open No. 4-89732, desired effects cannot be obtained because the flap pieces and the stepped portion are respectively formed on the case body and the lid without devices. To smoothly open/close the lid, the flap pieces must be movable inward in the case body during the opening/closing operation of the lid. In the conventional case described above, however, the flap pieces can rarely be moved inward in the case body because a space between each end portion of a wrap film core stored inside the case body and the corresponding side wall which supports the corresponding flap piece is very small or absent. For this reason, after the lid is closed and the flap pieces are engaged with the stepped portions, respectively, it is difficult to separate the flap pieces from the corresponding stepped portions. Therefore, the lid cannot be easily opened, resulting in inconvenience. Specially, it is important that the lid can be opened, because there are many instances where, in a home, a female user handles the lid by one hand.

When products, i.e., cases each storing a wrap film are stocked in a whorehouse or the like, a plurality of parallelepiped cases are stored in a cardboard box such that their longitudinal direction is aligned with the vertical direction, and a plurality (e.g., 10) of such cardboard boxes are generally stacked on each other and stocked. In this instance, the products in a lower cardboard box receive a large longitudinal load for a long period of time. In the conventional case described above, the right and left side walls of the case body are supported by the wrap film core. For this reason; when large inward forces act on the side walls during stocking, the flap pieces cannot move inward, and the flap pieces are excessively pressed against the side walls of the case body. As a result, an angle formed between each flap piece and the corresponding side wall often becomes very small. In this manner, when the flap pieces are excessively bent, the flap pieces cannot be smoothly swung. Therefore, it may be difficult to omen the lid.

To solve these problems there may be proposed a means for setting a distance between the right and left side walls of the case body to be much larger than the overall length of the wrap film core, thereby forming a space between each side wall and the corresponding core end portion to allow inward movement of each flap piece. When this space is formed, however, another problem such as collapse of the side walls during longitudinally stocking is posed.

SUMMARY OF THE INVENTION

It is a principal object of the present invention to provide a packaging case for a wrap film or the like, capable of smoothly opening/closing a lid and preventing the lid from floating.

In order to achieve the above object, according to an aspect of the present invention, there is provided a packaging case comprising a case body having a substantially rectangular bottom wall, side walls continuously formed with one pair of opposing edge portions of the bottom wall, and front and rear walls continuously formed with the other pair of opposing edge portions of the bottom wall and extending between the side walls, the case body being adapted to store an object to be packaged, and a lid having a substantially rectangular top wall continuously and pivotally formed with a top edge portion of the rear wall so as to cover and close an opening portion of the case body which is defined by top edge portions of the side walls; the front wall and the rear wall, lid side walls respectively continuously formed with a pair of edge portions adjacent to an edge portion of the top wall serving as a pivot center and located outside the side walls of the case body upon closing the opening portion with the top wall, and a lid front wall continuously formed with an edge portion of the top wall which opposes the edge portion serving as the pivot center, extending between the lid side walls, and located outside the front wall of the case body upon closing the opening portion with the top wall. Such a packaging case is characterized in that outwardly extending flap pieces are continuously and pivotally formed on top edge portions of the side walls of the case body, stepped portions are formed on inner surfaces of the lid side walls to engage with the flap pieces upon closing the opening portion with the top wall so as to prevent the lid from floating, and a thickness of a predetermined portion of each side wall of the case body which is continuous with a corresponding one of the flap pieces is set smaller than that of a remaining portion of this each side wall such that an inner surface of the remaining portion is located more inside of the case body than an inner surface of the predetermined portion.

According to this aspect of the present invention, since the predetermined portion of each side wall adjacent to the corresponding flap piece is thinned, the flap pieces can be easily moved inward in the case body during handling the lid.

The remaining portion has a large thickness except for this predetermined thin-walled portion. For this reason, the strength of the entire side walls can be kept high.

Since the inner surface of the thick-walled portion except for the thin-walled portion is located inward from the inner surface of the thin-walled portion, spaces are formed between the packaged object and the thin-walled portions in a state wherein the object is in contact with the thick-walled portions. For this reason, the flap pieces and the thick-walled portions can be displaced inward, and forces acting on the flap pieces can be absorbed. In this instance, since the thick-walled portions except for the thin-walled portions are supported by the packaged object, collapse of the side walls can be prevented.

DETAILED DESCRIPTION OF THE PREFERRED EMBODIMENT

Figure 1:
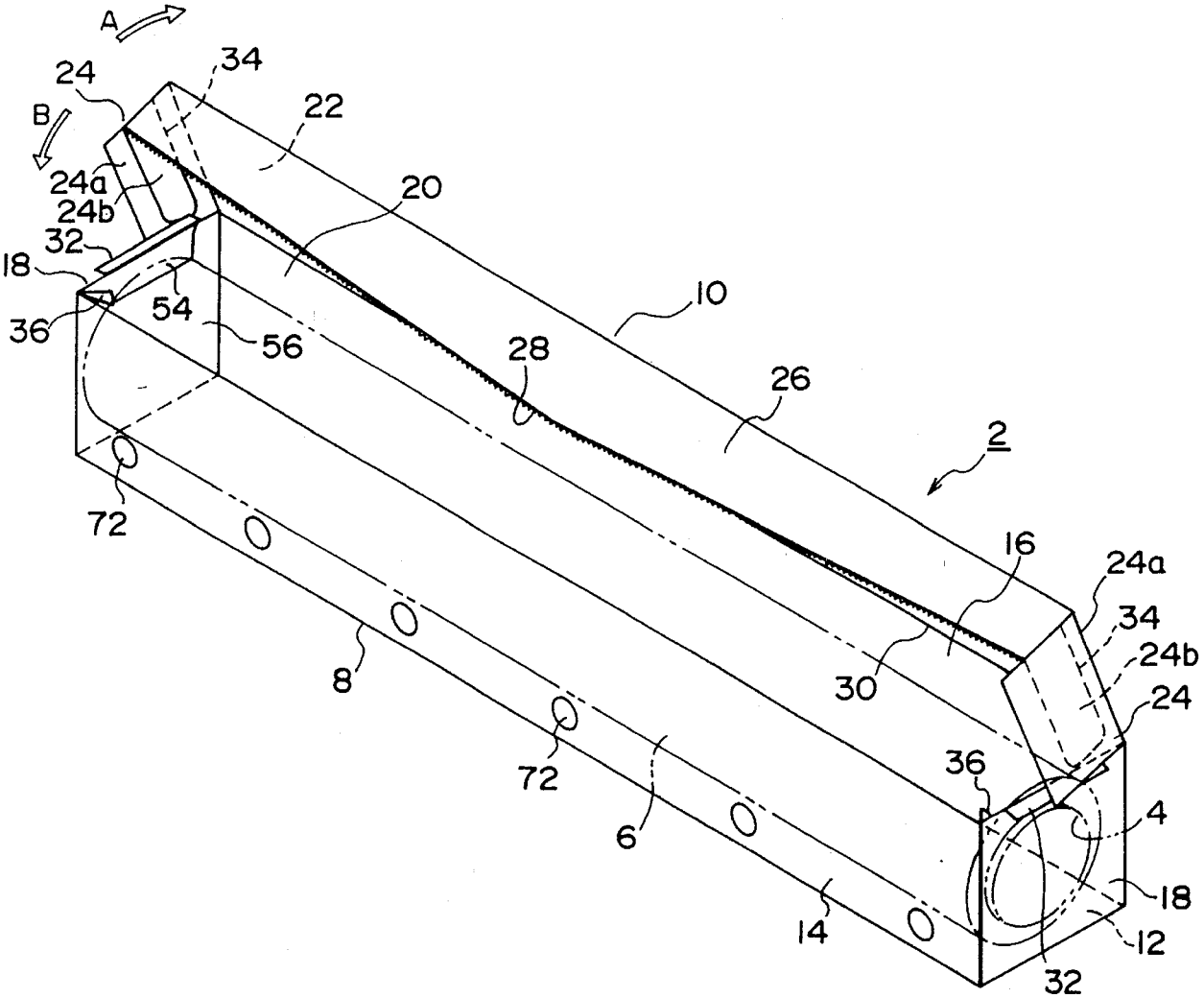
FIG. 1 is a perspective view showing a packaging case according to an embodiment of the present invention.

The preferred embodiment of the present invention will be described in detail with reference to the accompanying drawings. The same reference numerals throughout the drawings designate the same or corresponding parts.

FIG. 1 is a perspective view showing a case 2 for packaging a rolled wrap film as an object to be packaged, showing a state in which a lid is lifted upward. This case 2 is preferably made of a single piece of cardboard, and preferably a piece of coated cardboard having a weight per unit area of 270 to 600 g/m$^2$.

As shown in FIG. 1, the case 2 comprises a case body 8 for storing a wrap film 6 rolled on a cylindrical paper core 4 and a lid 10 integrally formed with the case body 8. The case 2 for storing a typical rolled wrap film, i.e., the wrap film 6 having a width of 300 mm and a length of 20 m and wound on the core 4 having the outer diameter of about 40 mm, a wall thickness of about 1 mm, and a length of about 380 mm generally has outer dimensions as a length of about 310 mm, a width of about 46 mm, and a height of about 46 mm.

Figure 2:
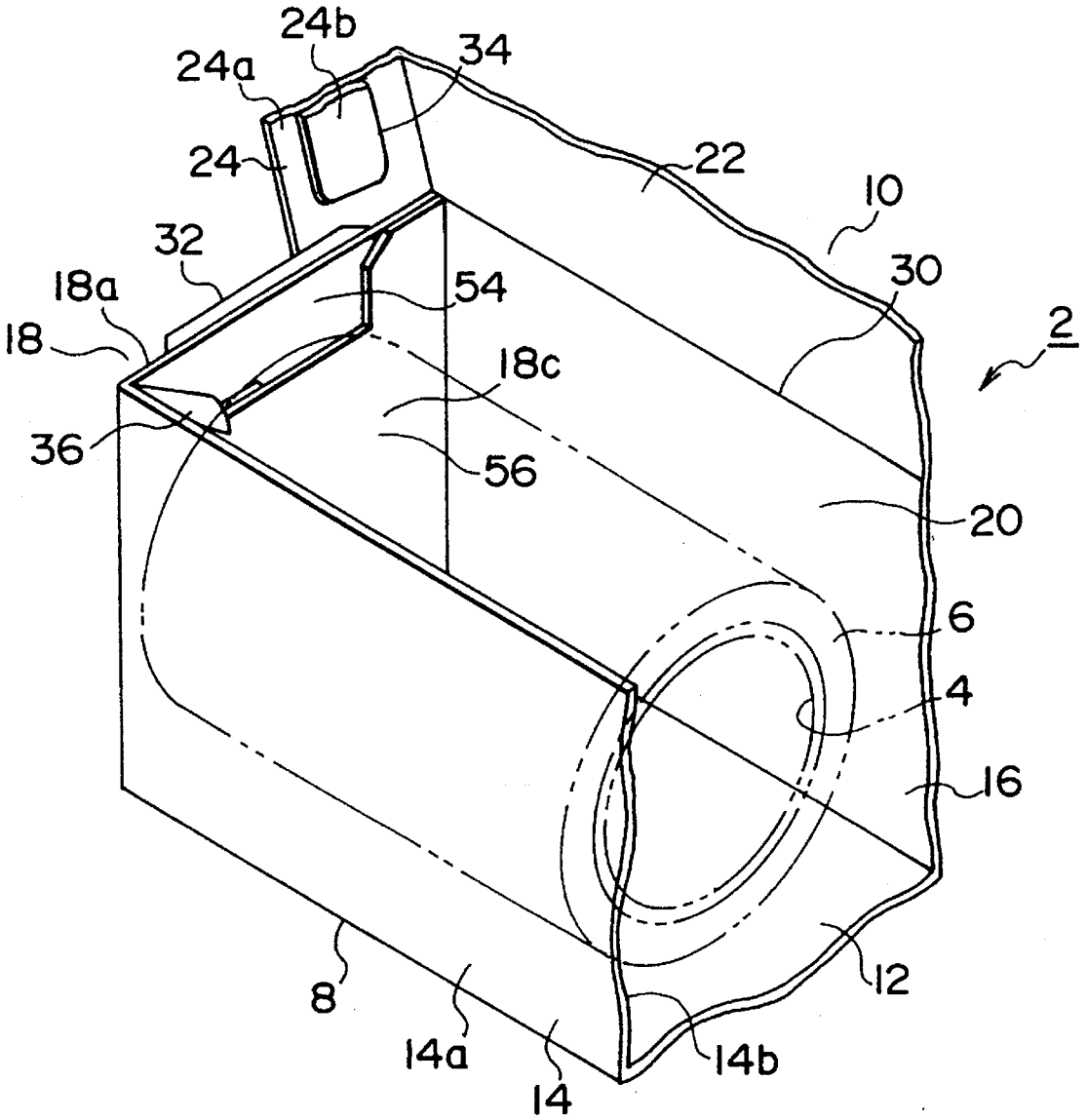
FIG. 2 is an enlarged perspective view showing a side portion of the case in FIG. 1.

As also shown in FIG. 2, the case body 8 comprises a rectangular bottom wall 12, front and rear walls 14 and 16 vertically extending upward from the long edge portions of this bottom wall 12, and side walls 18 vertically extending upward from the short edge portions of the bottom wall 12 and connecting the opposing end portions of the front and rear walls 14 and 16. The upper portion of the case body 8 is open as an opening portion 20 for allowing to pull the wrap film 6.

The lid 10 comprises a rectangular top wall 22 continuously extending from one top edge portion of the rear wall 16 of the case body 8 and shaped to substantially cover the opening portion 20 of the case body 8, lid side walls 24 vertically extending from the short edge portions of the top wall 22 and extending toward the case body 8, and a lid front wall 26 vertically extending from the front-side long edge portion of the top wall 22 and connecting the front-side end portions of the side walls 24. When the opening portion 20 is closed with the top wall 22 of the lid 10, the lid front wall 26 and the lid side walls 24 overlap the outer surfaces of the front wall 14 and the side walls 18 of the case body 8. A cutter 28 for cutting the pulled wrap film 6 is mounted on the inner surface at the edge portion of the lid front wall 26.

The top wall 22 of the lid 10 is continuous with the rear wall 16 of the case body 8, and the lid 10 is pivoted about a fold line or hinge 30 between the top wall 22 and the rear wall 16. This hinge 30 has slight restoration characteristics depending on the cardboard properties. For this reason, the lid 10 tends to pivot in a direction indicated by an arrow A in FIG. 1 to float from the case body 8. For this reason, according to the present invention, flap pieces 32 for preventing the lid from floating are formed at top edge portions of the side walls 18 of the case body 8, respectively. Also, stepped portions 34 engaged with these flap pieces 32 upon closing the opening portion 20 are formed on the inner surfaces of the corresponding lid side walls 24. The flap pieces 32 and the stepped portions 34 will be described in detail later. The right and left side walls 18 are substantially identical to each other, and similarly the lid side walls 24 are also identical to each other. For the descriptive convenience, one side wall 18 and one lid side wall 24 will be described below.

In this embodiment, as shown in FIG. 2, a part of the side wall 18 of the case body 8 is folded inward. This portion 36 is in contact with the outer surface at the corresponding end portion of the stored wrap film 6 and functions to prevent the wrap film 6 from falling through the opening portion 20.

This case 2 will be described in more detail with reference to the developed view thereof in FIG. 3.

Figure 3:
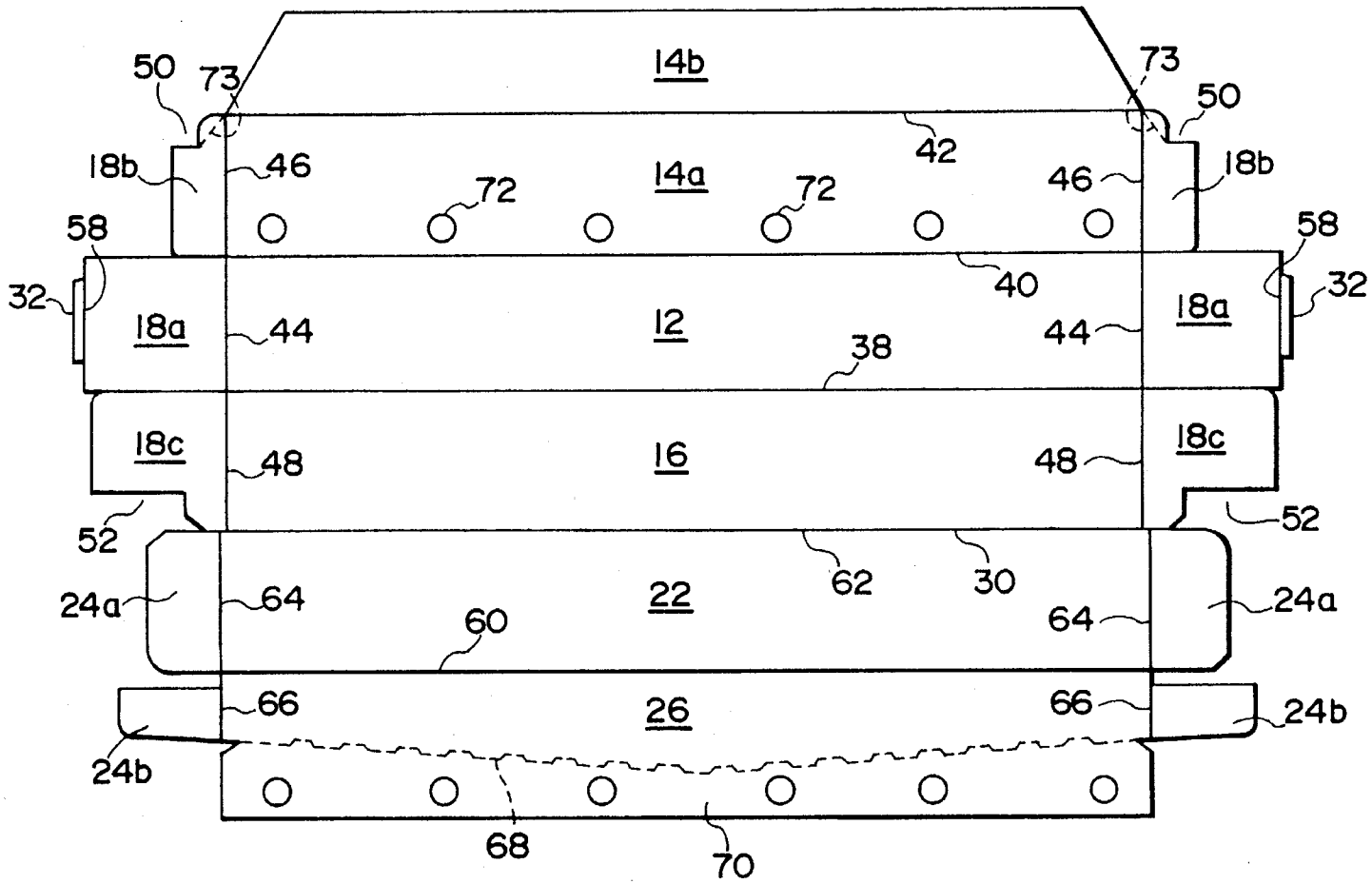
FIG. 3 is a developed view of the case in FIG. 1.

Referring to FIG. 3, the rectangular portion 12 constitutes the bottom wall of the case body 8. The portion 16 continuous with the long edge portion of this portion 12 serves as the rear wall. A portion 14*a* continuous with the other long edge portion of the portion 12 and a portion 14*b* continuous with the portion 14*a* constitute the front wall 14. The portions 16 and 14*a* are bent at about 90° , with respect to fold lines 38 and 40, respectively. The portion 14*b* is folded at a fold line 42 at about 180° with respect to the portion 14*a*. The portions 14*a* and 14*b* are adhered to each other with an adhesive.

Figure 4:
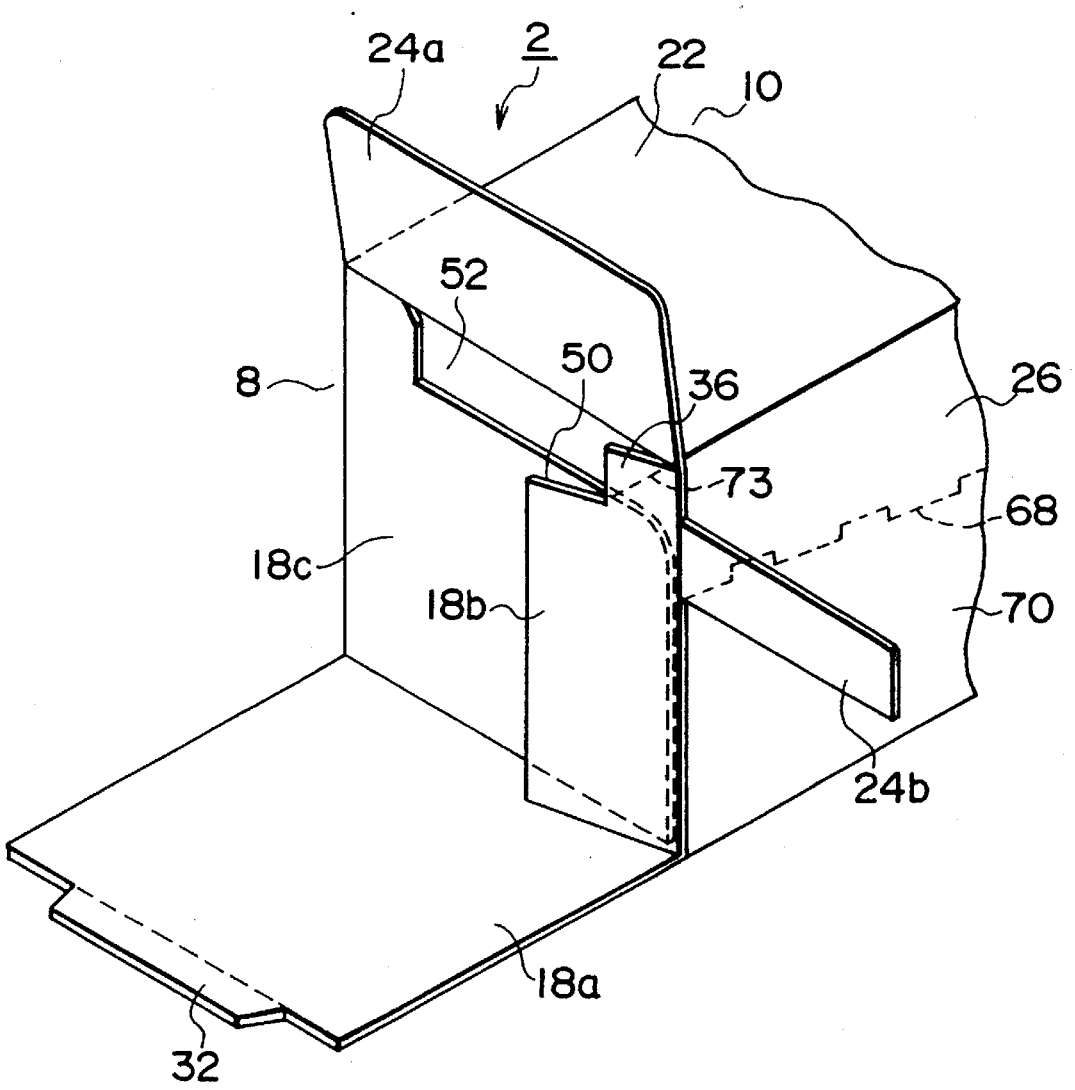
FIG. 4 is a perspective view showing part during assembly of the case.

A substantially square portion (first piece) continuous with each short edge portion of the portion 12, a portion (second piece) 18*b* continuous with each short edge portion of the portion 14*a* and a portion (third piece) 18*c* continuous with each short edge portion of the portion 16 constitute each of the right and left side walls 18 of the case body 8. As shown in FIG. 4, the portions 18*a*, 18*b* and 18*c* are bent at fold lines 44, 46, and 48 at about 90°, respectively. The portions 18*c*, 18*b*, and 18*a* are arranged in an order from the inside of the case body 8 and are adhered to each other with an adhesive.

Notches 50 and 52 are formed in the portions 18*b* and 18*c*, respectively. For this reason, when the portions 18*a*, 18*b* and 18*c* are adhered to each other, the upper portion of the side wall 18 of the case body 8 serves as a thin-walled portion, as can be apparent from FIGS. 1 and 5. This thin-walled portion 54 can be deformed with a small force as compared with a remaining thick-walled portion 56.

The portion (fourth piece) 32 continuous with the portion 18 *a* serves as the flap piece. This portion 32 is bend at a fold line 58 outward from the portion 18 *a*, i.e., the outer surface of the side wall 18. Note that this flap piece 32 preferably has perforations along the fold line 58 so as to maintain the flap piece 32 in an appropriate angular range (e.g.,10° to 90°) with respect to the outer surface of the side wall 18 in a non-load state. It is preferable that perforations each having a length of 3 mm to 5 mm are formed at an interval of 2 mm for the coated cardboard having the above weight per unit area. The perforations can allow smooth pivotal movement of the flap piece 32 about the fold line 58. When the flap piece 32 is moved, the flap piece 32 can return within the above angular range by an elastic restoration force of the portion at the fold line 58. Alternatively, instead of the perforations, the fold line 58 may be embossed to be of a recessed cross-sectional shape or a score having a predetermined depth may be formed in the fold line 58.

The portion 22 continuous with the portion 16 serves as the top wall. The portion 26 constituting the lid front wall extends from the long edge portion of the portion 22 which is located opposite to the portion 16. The portion 26 is bent at a fold line 60 at about 90° with respect to the portion 22. A fold line 62 between the portions 16 and 22 is a portion serving as a hinge for pivoting the lid 10. A portion (fifth piece) 24*a* continuous with each short edge portion of the portion 22 and a portion (sixth piece) 24*b* continuous with part of each short edge portion of the portion 26 constitute the lid side wall 24. These portions 24*a* and 24*b* are bent at fold lines 64 and 66 at about 90° and are adhered to each other in a state wherein the portion 24*b* is located inside the portion 24*a*.

A portion 70 extends from the portion 26 through perforations 68. The portion 70 is adhered to adhesion points 72 of the portion 14*a* before opening the case, thereby fixing the lid 10 to the case body 8. In use, the portion 70 is cut from the portion 26 along the perforations 68 and removed from the adhesion points 72. In this state, the lid 10 can pivot with respect to the case body 8, and the wrap film 6 can be pulled from the case body 8.

Figure 5:
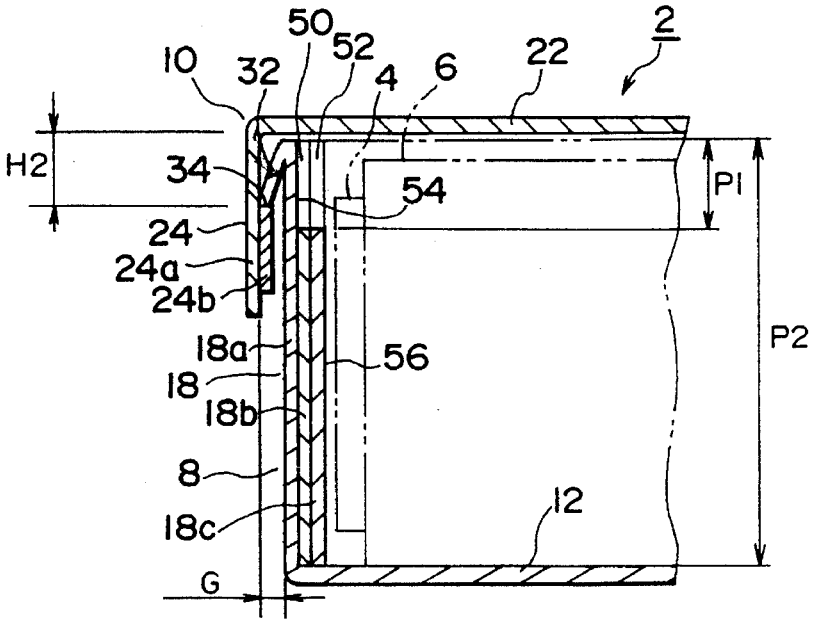
FIG. 5 is a sectional view schematically showing a flap piece engaged with a stepped portion of a lid.

The stepped portion 34 having an upward surface is formed on the inner surface of the lid side wall 24 constituted by adhering the portions 24 *a* and 24*b*, as shown in FIG. 5. When the lid 10 is closed, the free end of the flap piece 32 is engaged with the upward surface of this stepped portion 34, so that the lid 10 will not naturally float even if the user's hand is released from the lid 10.

Note that the fold lines preferably are embossed to be of recessed cross-sectional shapes by an embossing die, or scores having a predetermined depth are preferably formed in the fold lines so as to facilitate assembly of the case 2.

The portion 36 for preventing removal of the wrap film 6 is formed by bending a part of the portion 18*b* adjacent to the portion 14*b*. To facilitate bending of this portion 36, perforations 73 are preferably formed at a predetermined location of the portion 18*b*.

The functions of the flap piece 32 of the case body 8 and the stepped portion 34 of the lid 10 will be briefly described.

First of all, when the lid 10 is pivoted from the open state of FIG. 1 in a direction indicated by an arrow B, the inner surface of the portion 24*b* of the lid side wall 24 is brought into contact with the free end of the flap piece 32. The flap piece 32 and the upper thin-walled portion 54 of the side wall 18 of the case body 8 are urged inward. When the lid 10 reaches a closing position for closing the opening portion 20, the free end of the flap piece 32 is engaged with the stepped portion 34 of the lid side wall 24. Upon this engagement, the case body 8 and the flap piece 32 returns to the initial positions, thereby generating a clear snap sound. The user can recognize by this snap sound that the lid 10 is properly set at the closing position. As can be understood from FIG. 5, when the flap piece 32 is engaged with the stepped portion 34, the flap piece 32 serves as a stopper. Therefore, the lid 10 will not naturally float, and the opening portion 20 of the case body 8 will not be exposed outside.

Figure 7:
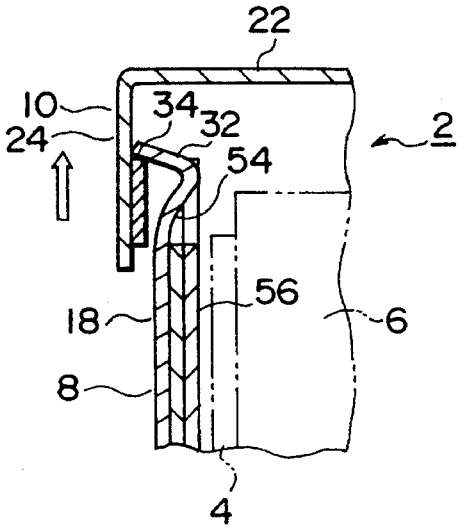
FIG. 7 is a sectional view schematically showing a state of the flap piece and the corresponding side wall during opening the lid.

To forcibly pivot the lid 10 in a direction indicated by an arrow A in FIG. 1 to open the opening portion 20, the flap piece 32 is pivoted upward about the top edge portion of the side wall 18 of the case body 8 and the upper thin-walled portion 54 of the side wall 18 is moved inward. As a result, the flap piece 32 is disengaged from the stepped portion 34, and the lid 10 can be opened (FIG. 7).

To assure such an operation, the sizes and shapes of the respective portions of the case 2 are very important factors. Various sizes can be assumed for the respective portions. In the case 2 having the typical size and shape described above, we found from various tests that a desired effect can be obtained when the following conditions are satisfied. That is, the following numerical values are obtained, in the instance that the case 2 is made of coated cardboard having the weight per unit area of 270 to 600 g/m$^2$ and has outer dimensions consisting of a length of about 310 mm, a width of about 46 mm, and a height of about 46 mm, and a rolled wrap film is the wrap film 6 having a width of 300 mm and a length of 20 m and wound on the core 4 having an outer diameter of about 40 mm, a wall thickness of about 1 mm, and a length of about 380 mm.

Figure 8:
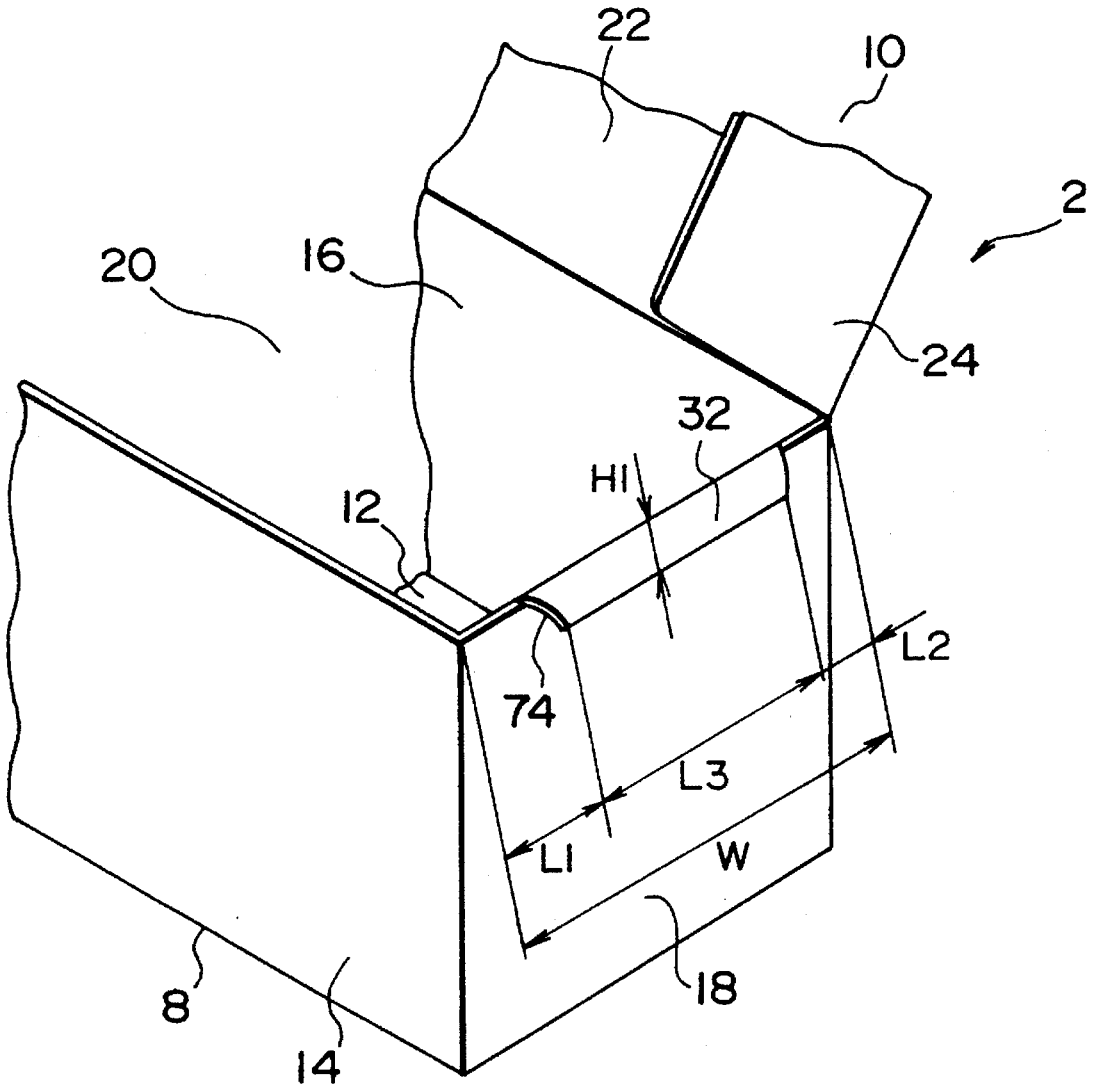
FIG. 8 is a perspective view showing part of the shape of a flap piece in the case in FIG. 1.

As shown in FIGS. 5 and 8, if the width of the flap piece 32 of the case body 8 is defined as H1 and a distance between the stepped portion 34 of the lid side wall 24 and the top wall 22 is defined as H2; a ratio H2/H1 is preferably set to satisfy $1.1 \leqq H2/H1 \leqq 5.0$, and more preferably $1.2 \leqq H2/H1 \leqq 2.0$. When the ratio H2/H1 exceeds 5.0 or less than 1, occasionally the lid 10 will not be closed, and even if the lid 10 is closed, the closed state of the lid 10 becomes unstable.

As shown in FIG. 5, if a distance or gap between the inner surface of the lid side wall 24 and the outer surface of the slide wall 18 of the case body 8 is defined as G, the gap G, the width H1, and the distance H2 must physically satisfy condition $H2 > H1 > G$. If this condition is not satisfied, the flap piece 32 cannot be engaged with the stepped portion 34 of the lid 10, and floating of the lid 10 cannot be prevented. The present inventors made various tests to obtain a relationship between the value of G and H1. A ratio H1/G was found to be optimal to satisfy $1.1 \leqq H1/G \leqq 10.00$, and more preferably $1.3 \leqq H1/G \leqq 3.0$. When the ratio H1/G is less than 1.1, the locked state of the lid 10 with respect to the case body 8 becomes unstable. However, when the ratio H1/G exceeds 10.0, the flap piece 32 interferes with the lid 10, and it becomes difficult to cap the case body 8 with the lid 10. Note that in view of manufacturing, the width H1 is preferably set to about 3.5 mm.

As shown in FIG. 8, the flap piece 32 does not extend along the overall width of the side wall 18 of the case body 8. The front-wall-side portion and rear-wall-side portion of the flap piece 32 are notched. If the width of the side wall 18 is defined as W, a length L1 of the front-wall-side notched portion is preferably set to satisfy $0.05W \leqq L1 \leqq 0.30W$, and more preferably $0.08W \leqq L1 \leqq 0.12W$. If the length L1 is less than 0.05W, the flap piece 32 is firmly engaged with the stepped portion 34 of the lid 10 at the corner on the front wall 14 side of the case body 8. For this reason, the lid 10 cannot be easily lifted. If the length L1 exceeds 0.30W, the durability and function of the flap piece 32 are degraded. In the illustrated embodiment, corner portions 74 of the flap piece 32 are inclined due to the following reason. When the lid 10 is to be lifted, the portions 74 are brought into contact with the stepped portion 34 first, and right-angled corner portions are weakened within a short period of time.

If the length of the rear-wall-side notched portion is defined as L2, the length L2 is preferably set to satisfy $0.05W \leqq L2 \leqq 0.30W$, and more preferably $0.18W \leqq L2 \leqq 0.22$ W. If the length L2 is less than 0.05W, an abutment between the rear end portion of the flap piece 32 and lid side wall 24 hinders the pivotal movement of the flap piece 32 and the lid 10 cannot be lifted easily. If the length L2 exceeds 0.30W, durability of the function of the flap piece 32 are degraded, resulting in inconvenience.

The thin-walled portion 54 of the side wall 18 of the case body 8 is provided to smoothly move the flap piece 32 inward. To achieve this purpose, the thin-walled portion 54 is preferably formed as large as possible. However, as previously described, since the cases 2 are stacked in its longitudinal directions, an unlimited increase in size of the thin-walled portion 54 does not allow to keep the strength of the side wall 18 of the case body 8.

According to the present invention, in a state wherein the rolled wrap film 6 is stored in the case body 8, the position of the lower edge portion of the almost rectangular thin-walled portion 54 is located below the uppermost portion of the end of the wrap film core 4 by several mm (e.g., 2 mm to 6 mm), as shown in FIG. 5. When the dimensions are thus determined, the thick-walled portion 56 except for the thin-walled portion 54 is kept relatively wide.

Figure 6:
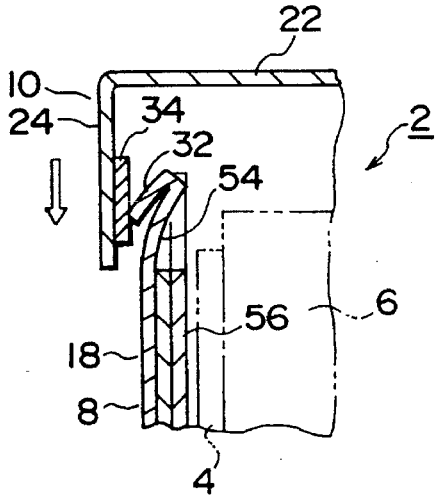
FIG. 6 is a sectional view schematically showing a state of the flap piece and the corresponding side wall during closing the lid.

As shown in FIGS. 5 to 7, in this embodiment, the thick-walled portion 56 has a thickness of two or three pieces of cardboard and is supported by the end face of the core 4. Therefore the side wall 18 has a sufficiently high strength. On the other hand, the thin-walled portion 54 has a thickness of only one piece of cardboard, and a space of at least two pieces of cardboard is formed between the portion 54 and the end face of the core 4. For these reasons, when an inward force acts on the portion 54 through the flap piece 32, the flap piece 32 and the thin-walled portion 54 of the side wall 18 can be very easily displaced inward. Even if the flap piece 32 is strongly pressed, the pressing force can be absorbed by the displacement of the thin-walled portion 54 of the side wall 18, and the flap piece 32 will not collapse.

If the position of the lower edge portion of the thin-walled portion 54 is located at or above the uppermost portion of the end of the core 4, the thin-walled portion 54 tends not to be displaced. The smooth pivotal movement of the lid 10 and the floating preventive effect of the lid 10 cannot be obtained.

The dimensional conditions of the thin-walled portion 54 of the side wall 18 can be described as follows. As shown in FIG. 5, if the length of the thin-walled portion 54 in the direction of height is defined as P1 and the height of the side wall 18 is defined as P2, a ratio P1/P2 is preferably set to satisfy $0.13 \leqq P1/P2 \leqq 0.55$, and more preferably $0.15 \leqq P1/P2 \leqq 0.30$. If the ratio P1/P2 exceeds 0.55, the strength of the side wall 18 becomes insufficient, and the strength of the overall case 2 is decreased. On the other hand, if the ratio P1/P2 is less than 0.15, the flap piece 32 cannot be easily displaced inward in the case body 8. Smooth opening/closing of the lid 10 cannot be assured, as described above.

Note that the width of the thin-walled portion 54, i.e., the length along the top edge portion of the side wall 18 is preferably set equal to the length L3 of the corresponding flap piece 32.

The performance test of case samples according to the present invention will be described below. In this test, two samples 1 and 2 according to the present invention and one sample 3 having the conventional structure as a comparative sample were prepared. The cases in samples 1, 2, and 3 were manufactured on the basis of the specifications to be described in Table 1 below. The outer dimensions of these sample cases, and the dimensions of the rolled wrap films stored therein were equal to those described above. These samples stored rolled wrap films, and the portions 70 to be cut off, which were continuous with the front walls of the lids, were kept adhered to the front walls of the case bodies. That is, the sample cases were used substantially in the same condition in the form of products before opening the cases.

TABLE 1

| | | Sample 1 | Sample 2 | Sample 3 |
|---|---|---|---|---|
| Length L1 of Front-Side Notched Portion of Flap Piece | | 7 | 5 | 0 |
| Length L2 of Rear-Side Notched Portion of Flap Piece | | 9.5 | 9.5 | 0 |
| Width W of Side Wall of Case Body | | 46.5 | 46.5 | 46.5 |
| Perforations of Fold line for Forming Flap Piece | Size | 5 | 3 | 5 |
| | Interval | 2 | 2 | 2 |
| Extension Length H1 of Flap Piece | | 3.5 | 3.5 | 3.5 |
| Distance H2 between Lid Top Wall and Stepped Portion | | 5 | 5 | 5 |
| Gap G between Lid Side Wall and Side Wall of Case Body | | 2 | 2 | 2 |
| Height P1 of Thin-Walled Portion | | 10 | 10 | 10 |
| Height P2 of Side Wall of Case Body | | 46 | 46 | 46 |

The performance test using these samples includes a lid opening test and a lid closing test.

The lid opening test was performed as follows. 50 samples were stored in one cardboard box such that the longitudinal direction of the samples was aligned with the vertical direction, and 15 cardboard boxes each prepared as described above were stacked on each other and were left still for two weeks. The lowest cardboard box to the fifth lowest cardboard box were selected, and 250 samples stored therein were reseed whether each lid could be easily opened. More specifically, after the portion 70 to be cut off is removed from each sample, and the lid was manually opened. The test results are summarized in Table 2 below. In this test, five panelists were prepared, and each panelist opened 50 samples. In Table 2, a mark "⊙" indicates that a sample could be opened with one hand, a mark "○" indicates that a sample could be opened with one hand with difficulty, a mark "Δ" indicates that a sample could not be opened with one hand, but could be opened with both hands, and a mark "x" indicates that a sample could not be opened with even both hands.

TABLE 2

| | ◎ | ○ | Δ | x |
|---|---|---|---|---|
| Sample 1 | 95.6 | 4.4 | 0 | 0 |
| Sample 2 | 98.4 | 1.6 | 0 | 0 |
| Sample 3 | 66.0 | 26.0 | 8.0 | 0 |

The unit of the numerical values in Table 2 is %.

The lid closing test is a test for checking a closing degree obtained when a lid in an open state of each sample is closed with one hand. More specifically, it was checked if the flap pieces at two sides of each case body were properly engaged with the stepped portions of the side walls of the lid when the lid was forcibly fitted on the case body. The number of samples and the number of panelists were the same as in the above test. The test results are summarized in Table 3 below. In Table 3, a mark "◎" indicates that the flap pieces at the two sides were properly fitted in the stepped portions, a mark "Δ" indicates that only one flap piece was properly fitted in the corresponding stepped portion, and a mark "x" indicates that the flap pieces at the two sides were not fitted in the stepped portions.

TABLE 3

| | ◎ | Δ | x |
|---|---|---|---|
| Sample 1 | 95.6 | 4.4 | 0 |
| Sample 2 | 99.2 | 0.8 | 0 |
| Sample 3 | 79.2 | 19.2 | 1.6 |

The unit of the numerical values in Table 2 is %.

Judging from the above test results, the case performance of the cases according to the present invention is apparently greatly improved as compared with the conventional case. Specially, as in the cases according to the present invention; the lid can be easily opened and closed with one hand, the cases are suitable for an actual using manners in a home.

The preferred embodiment of the present invention has been described in detail. However, the present invention is not limited to the sizes and forms of the above embodiment. In the above embodiment, the shape of the thin-walled portion 54 of the side wall 18 is almost rectangular. If a desired function can be obtained, the shape is not limited to the rectangular shape. The free end of the flap piece 32 need not be linear, but can be a corrugated shape. In addition, the case 2 may be made of a material except for paper, such as a plastic material.

Figure 9:
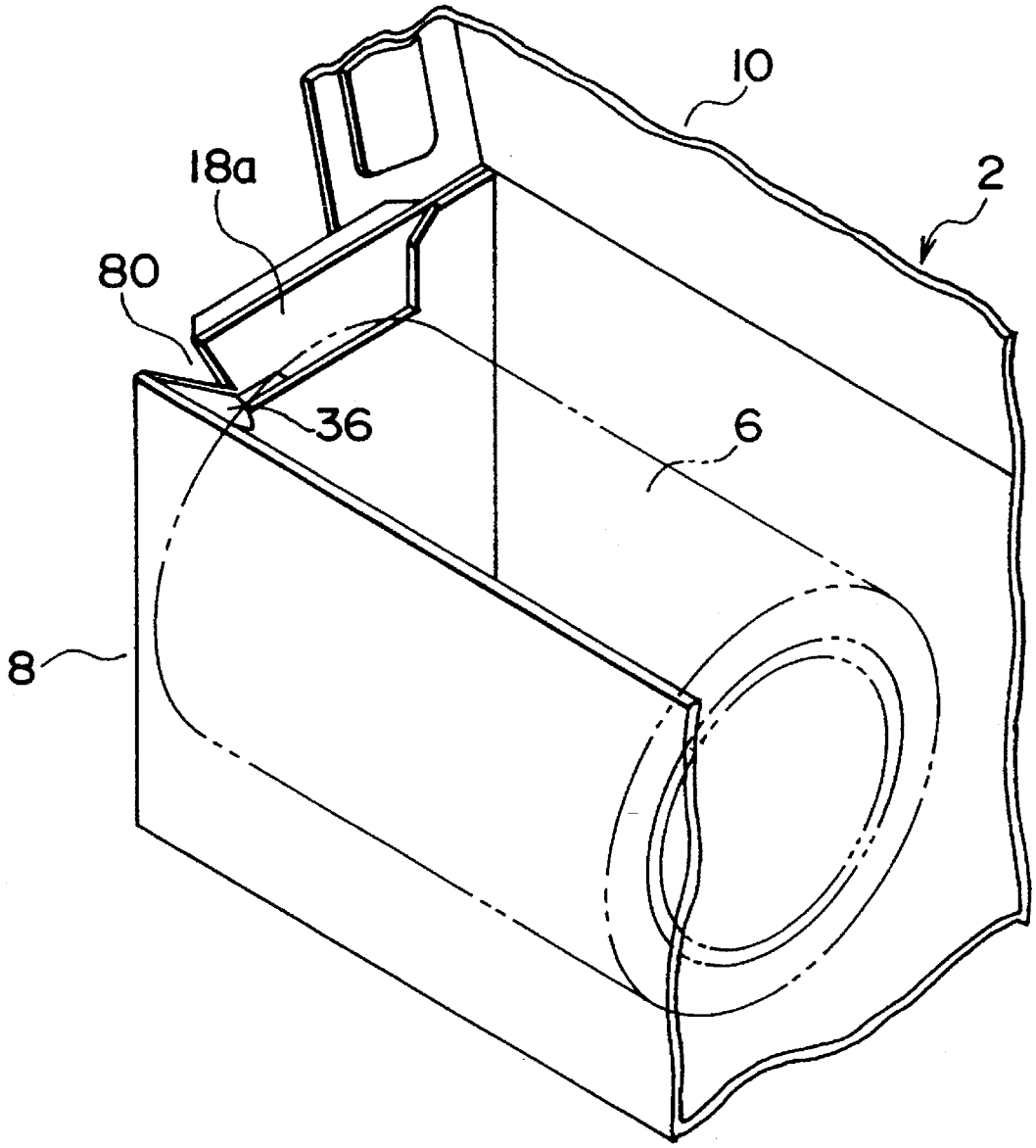
FIG. 9 is a perspective view showing part of a modification of the present invention.

In the above embodiment, as the removal preventive means of the wrap film 6, the portion 36 of the side wall 18 is bent. However, this portion 36 may be bent by the user after the user opens the case. In this case, part of the side wall 18 which opposes the portion 36 is preferably notched to allow the user to easily bend the portion 36. More specifically, a notch 80 shown in FIG. 9 is preferably formed in part of the first piece 18*a* opposing the portion 36.

The above embodiment has exemplified a packaging case for a wrap film. However, the case according to the present invention is also applicable to other articles such as a rolled aluminum foil.

As has been described above, according to the present invention, when the case body is capped by the lid, the flap pieces formed on the side walls of the case body are properly fitted in the stepped portions of the side walls of the lid, thereby properly preventing floating of the lid. After the lid is closed, the opening portion of the case body will not be accidentally exposed to the outside, thus providing a sanitary case and preventing wrap film rewinding and its removal.

The upper portions of the side walls which support the flap pieces can be easily moved inward in the case body. For this reason, the opening/closing operation of the lid can be smoothly performed, and the case and an article therein can be more easily handled. The easy opening/closing operation is an important effect, because there are many instances where a wrap film case must be handled by one hand in a home.

In addition, the most of each side wall is thick and supported by the corresponding end portion of the core. Even if such cases are stacked on each other, the side walls will not be deformed. On the other hand, forces acting on the flap pieces are absorbed by the displacements of the upper thin-walled portions of the side walls, and the flap pieces will not collapse. Therefore, the lid can be smoothly pivoted even if the case is stocked, in the state that its longitudinal direction is aligned with the vertical direction, for a long period of time.

Since the inward movement of the flap pieces can be facilitated, a clear snap sound is spontaneously generated upon engagement between the flap pieces and the stepped portions. Therefore, the user can check by this snap sound that the lid is properly closed.

From the invention thus described, it will be obvious that the invention may be varied in many ways. Such variations are not to be regarded as a departure from the spirit and scope of the invention, and all such modifications as would be obvious to one skilled in the art are intended to be included within the scope of the following claims.

The basic Japanese Application Nos. UM-72122/1993 filed on Dec. 15, 1993 and 133640/1994 filed on May 24, 1994 are hereby incorporated by reference.

What is claimed is:

1. A packaging case comprising:

a case body having a substantially rectangular bottom wall, side walls respectively continuously formed with one pair of opposing edge portions of said bottom wall, and front and rear walls respectively continuously formed with the other pair of opposing edge portions of said bottom wall and extending between said side walls, said case body being adapted to store an object; and a lid having a substantially rectangular top wall continuously and pivotally formed with a top edge portion of said rear wall so as to cover and close an opening portion of said case body which is defined by top edge portions of said side walls, said front wall and said rear wall, lid side walls respectively continuously formed with a pair of edge portions adjacent to an edge portion of said top wall serving as a pivot center, and located outside said side walls of said case body upon closing said opening portion with said top wall, and a lid front wall continuously formed with an edge portion of said top wall which opposes said edge portion serving as the pivot center, extending between said lid side walls, and located outside said front wall of said case body upon closing said opening portion with said top wall, wherein outwardly extending flap pieces are continuously and pivotally formed on the top edge portions of said side walls of said case body, stepped portions are formed on inner surfaces of said lid side walls to engage with said flap pieces upon closing said opening portion with said top wall so as no prevent said lid from floating; and a thickness of a predetermined portion of each side wall of said case body which faces to a corresponding one of said flap pieces is set smaller than that of a remaining portion of said each side wall such that an inner surface of said remaining portion is located more inside of said case body than an inner surface of said predetermined portion.

2. A case according to claim 1, wherein each of said side walls of said case body comprises a first piece extending from said bottom wall, a second piece extending from one of said front and rear walls of said case body and located inside said first piece, and a third piece extending from the other of said front and rear walls of the said case body and located inside said second piece, said first to third pieces being adhered to each other; and portions of said second and third pieces which correspond to said predetermined portion being removed.

3. A case according to claim 2, wherein each of said flap pieces is formed by bending, along a fold line, a fourth piece continuously formed with said first piece.

4. A case according to claim 3, wherein the fold line has one selected from the group consisting of perforations, a score having a predetermined depth, and an embossment.

5. A case according to claim 4, wherein each of said perforations has a length of 3 mm to 5 mm and the perforations are formed at an interval of about 2 mm.

6. A case according to claim 1, wherein each of said lid side walls comprises a fifth piece extending from said top wall and a sixth piece extending from said lid front wall and located inside said fifth piece, said fifth and sixth pieces being adhered with each other, and each of said stepped portions is formed by said sixth piece spaced apart from an inner surface of said top wall by a sufficient distance to be engaged with a corresponding one of said flap pieces.

7. A case according to claim 6, wherein the following condition is satisfied:

$$1.1 \leqq H2/H1 \leqq 5.0$$

where H1 is an extension length of each of said flap pieces from said top edge portion of a corresponding one of said side walls of said case body, and H2 is a distance from said top wall of said lid to said stepped portions.

8. A case according to claim 6, wherein the following condition is satisfied:

$$1.1 \leqq H1/G \leqq 10.0$$

where H1 is an extension length of each of said flap pieces from said top edge portion of a corresponding one of said side walls of said case body, and G is a gap from an inner surface of each of said lid side walls to an outer surface of a corresponding one of said side walls of said case body.

9. A case according to claim 1, wherein front end portions of said flap pieces located on a front wall side of said case body are spaced apart from an outer surface of said front wall by a predetermined first distance.

10. A case according to claim 9, wherein the following condition is satisfied:

$$0.05W \leqq L1 \leqq 0.30W$$

where L1 is the first distance, and w is a length of each of said side walls of said case main body along said top edge portion of said each side wall.

11. A case according to claim 1, wherein rear end portions of said flap piece located on a rear wall side of said case body are spaced apart from an outer surface of said rear wall by a predetermined second distance.

12. A case according to claim 11, wherein the following condition is satisfied:

$$0.05W \leqq L2 \leqq 0.30W$$

where L2 is the second distance, and w is a length of each of said side walls of said case body along said top edge portion of said each side wall.

13. A case according to claim 1, wherein said flap piece is kept in a predetermined angular range with respect to a corresponding one of said outer surfaces of said side walls in a non-load state.

14. A case according to claim 13, wherein the angular range is 10° to 90°.

15. A case according to claim 1, wherein an edge portion of said predetermined portion on a bottom wall side extends parallel to said top edge portion of a corresponding one of said side walls of said case body.

16. A case according to claim 15, wherein the following condition is satisfied:

$$0.13 \leqq P1/P2 \leqq 0.55$$

where P1 is a distance from said top edge portion of each of said side walls of said case body to said edge portion of said predetermined portion, and P2 is a distance from said top edge portion to a bottom edge portion of said each side wall.

17. A case according to claim 1, wherein said object is a wrap film rolled on a cylindrical core.

18. A case according to claim 17, wherein in a state in which said rolled wrap film is stored in said case body so that an axis of said core is substantially parallel to said front and rear walls of said case body, said edge portion of said predetermined portion on a bottom surface side is located at a position shifted by 2 mm to 6 mm toward the bottom wall side from a position of a corresponding end face of said core farthest from said bottom wall.

19. A case according to claim 1, wherein a length of said predetermined portion of said case body along said top edge portion of each of said side walls is substantially equal to a length of a corresponding one of said flap pieces along said top edge portion of said each side wall.

20. A case according to claim 1, wherein portions of said side walls of said case body are bent inward to form object removal preventive members.

21. A case according to claim 20, wherein a fold line is formed at a predetermined portion of each of said side walls of said case body to form said removal preventive member after opening said case.

22. A case according to claim 20, wherein when each of said side walls of said case body comprises a first piece extending from said bottom wall, a second piece extending from one of said front and rear walls of said case body and located inside said first piece, and a third piece extending from the other of said front and rear walls of the said case body and located inside said second piece, said first to third pieces being adhered to each other, each of said removal preventive members being formed by bending a part of said second or third piece.

23. A case according to claim 22, wherein a fold line is formed at a predetermined portion of said second or third piece to form said removal preventive member after opening said case, and a notch is formed in a portion of said first piece which opposes a portion prospectively serving as said removal preventive member.

24. A case according to claim 1, wherein said case is made of one piece of cardboard.

25. A case according to claim 24, wherein said cardboard is coated cardboard having a weight per unit area of 270 $g/m^2$ to 600 $g/m^2$.

26. A case according to claim 1, further comprising a rolled wrap film stored in said case body.

27. A case according to claim 26, wherein rear end portions of said flap piece located on a rear wall side of said case body are spaced apart from an outer surface of said rear wall by a predetermined second distance.

28. A case according to claim 27, wherein the following condition is satisfied:

$$0.05W \leqq L2 \leqq 0.30W$$

where L2 is the second distance, and W is a length of each of said side walls of said case body along said top edge portion of said each side wall.

29. A packaging case comprising:

a case body having a substantially rectangular bottom wall, side walls respectively continuously formed with one pair of opposing edge portions of said bottom wall, and front and rear walls respectively continuously formed with the other pair of opposing edge portions of said bottom wall and extending between said side walls, said case body being adapted to store an object; and a lid having a substantially rectangular top wall continuously and pivotally formed with a top edge portion of said rear wall so as to cover and close an opening portion of said case body which is defined by top edge portions of said side walls, said front wall and said rear wall, lid side walls respectively continuously formed with a pair of edge portions adjacent to an edge portion of said top wall serving as a pivot center and located outside said side walls of said case body upon closing said opening portion with said top wall, and a lid front wall continuously formed with an edge portion of said top wall which opposes said edge portion serving as the pivot center, extending between said lid side walls, and located outside said front wall of said case body upon closing said opening portion with said top wall, wherein outwardly extending flap pieces are continuously and pivotally formed on top edge portions of said side walls of said case body, stepped portions are formed on inner surfaces of said lid side walls to engage with said flap pieces upon closing said opening portion with said top wall so as to prevent said lid from floating, and front end portions of said flap pieces located on a front surface side of said case body are spaced apart from an outer surface of said front wall by a predetermined first distance.

30. A case according to claim 29, wherein the following condition is satisfied:

$$0.05W \leqq L1 \leqq 0.30W$$

where L1 is the first distance, and W is a length of each of said side walls of said case main body along said top edge portion of said each side wall.

31. A case according to claim 29, wherein each of said side walls of said case body comprises a first piece extending from said bottom wall, a second piece extending from one of said front and rear walls of said case body and located inside said first piece, and a third piece extending from the other of said front and rear walls of the said case body and located inside said second piece, said first to third pieces being adhered to each other, and each of said flap pieces is formed by bending a fourth piece continuous with said first piece along a fold line.

32. A case according to claim 31, wherein the fold line has one selected from the group consisting of perforations, a score having a predetermined depth, and an embossment.

33. A case according to claim 32, wherein each of said perforations has a size of 3 mm to 5 mm, and the perforations are formed at an interval of about 2 mm.

34. A case according to claim 27, wherein each of said lid side walls comprises a fifth piece extending from said top wall and a sixth piece extending from said lid front wall and located inside said fifth piece, said fifth and sixth pieces being adhered with each other, and each of said stepped portions is formed by said sixth piece spaced apart from an inner surface of said top wall by a sufficient distance to be engaged with a corresponding one of said flap pieces.

35. A case according to claim 34, wherein the following condition is satisfied:

$$1.1 \leqq H2/H1 \leqq 5.0$$

where H1 is an extension length of each of said flap pieces from said top edge portion of a corresponding one of said side walls of said case body, and H2 is a distance from said top wall of said lid to said stepped portions.

36. A case according to claim 34, wherein the following condition is satisfied:

$$1.1 \leqq H1/G \leqq 10.0$$

where H1 is an extension length of each of said flap pieces from said top edge portion of a corresponding one of said side walls of said case body, and G is a gap from an inner surface of each of said lid side walls to an outer surface of a corresponding one of said side walls of said case body.

37. A case according to claim 29, wherein said flap piece is kept in a predetermined angular range with respect to a corresponding one of said outer surfaces of said side walls in a non-load state.

38. A case according to claim 29, wherein the angular range is 10° to 90°.

39. A case according to claim 29, wherein portions of said side walls of said case body are bent inward to form object removal preventive members.

40. A case according to claim 39, wherein a fold line is formed at said predetermined portion of each of said side walls of said case body to form said removal preventive members after opening said case.

41. A case according to claim 39, wherein when each of said side walls of said case body comprises a first piece extending from said bottom wall, a second piece extending from one of said front and rear walls of said case body and located inside said first piece, and a third piece extending from the other of said front and rear walls of the said case body and located inside said second piece, said first to third pieces being adhered to each other, each of said removal preventive members being formed by bending a part of said second or third piece.

42. A case according to claim 41, wherein a fold line is formed at a predetermined portion of said second or third piece to form said removal preventive member after opening said case, and a notch is formed in a portion of said first piece which opposes a portion prospectively serving as said removal preventive member.

43. A case according to claim 29, wherein said case is made of one piece of cardboard.

44. A case according to claim 43, wherein said cardboard is coated cardboard having a weight per unit area of 270 $g/m^2$ to 600 $g/m^2$.

45. A case according to claim 29, further comprising a rolled wrap film stored in said case body.

46. A packaging case comprising:

a case body having a substantially rectangular bottom wall, side walls respectively continuously formed with one pair of opposing edge portions of said bottom wall, and front and rear walls respectively continuously formed with the other pair of opposing edge portions of said bottom wall and extending between said side walls, said case body being adapted to store an object;

a lid continuously and pivotally formed with a top edge portion of said rear wall so as to cover and close an opening portion of said case body which is defined by top edge portions of said side walls, said front wall and said rear wall; and wherein each of said side walls of said case body comprises a first piece extending from said bottom wall, a second piece extending from one of said front and rear walls of said case body and located inside said first piece, and a third piece extending from the other of said front and rear walls of said case body and located inside said second piece, said first to third pieces being adhered to each other with an adhesive, wherein a fold line is formed at a predetermined portion of one of said second and third pieces to form an object removal preventive member by bending inward in said case body a part of one of said second and third pieces after opening said case, and a notch is formed in a portion of said first piece which opposes said part serving as one of said removal preventive member.

* * * * *